US010752980B2

(12) United States Patent
Li et al.

(10) Patent No.: US 10,752,980 B2
(45) Date of Patent: Aug. 25, 2020

(54) ADVANCED CAST ALUMINUM ALLOYS FOR AUTOMOTIVE ENGINE APPLICATION WITH SUPERIOR HIGH-TEMPERATURE PROPERTIES

(71) Applicant: Ford Global Technologies, LLC, Dearborn, MI (US)

(72) Inventors: Mei Li, Bloomfield Hills, MI (US); Jacob Wesley Zindel, Ann Arbor, MI (US); Larry Alan Godlewski, Fenton, MI (US); Bita Ghaffari, Ann Arbor, MI (US); Yang Huo, Dearborn, MI (US); Carlos Engler-Pinto, Dearborn, MI (US); Wei-jen Lai, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 299 days.

(21) Appl. No.: 15/663,510

(22) Filed: Jul. 28, 2017

(65) Prior Publication Data

US 2019/0032179 A1 Jan. 31, 2019

(51) Int. Cl.
*C22C 21/02* (2006.01)
*C22C 21/04* (2006.01)
(Continued)

(52) U.S. Cl.
CPC ..... *C22F 1/043* (2013.01); *B22D 21/007* (2013.01); *C22C 21/02* (2013.01); *C22C 21/04* (2013.01)

(58) Field of Classification Search
CPC ..... C22F 1/04–057
See application file for complete search history.

(56) References Cited

U.S. PATENT DOCUMENTS 8,758,529 B2 6/2014 Wang et al.
2004/0213694 A1 10/2004 Wolverton et al.
(Continued)

FOREIGN PATENT DOCUMENTS

DE 10026626 5/2001
EP 1975262 4/2012
(Continued)

OTHER PUBLICATIONS

Molina, R., Amalberto, P., Rosso, M., Mechanical characterization of aluminium alloys for high temperature applications Part 2: Al—Cu, Al-—Mg alloys; Metallurgical Science and Technology, 2011, vol. 29-2, pp. 5-13,Teksid Aluminum SrL, Southfield, MI.
(Continued)

*Primary Examiner* — Lois L Zheng
(74) *Attorney, Agent, or Firm* — Burris Law, PLLC

(57) ABSTRACT

A high fatigue strength aluminum alloy comprises in weight percent copper 3.0-3.5%, iron 0-1.3%, magnesium 0.24-0.35%, manganese 0-0.8%, silicon 6.5-12.0%, strontium 0-0.025%, titanium 0.05-0.2%, vanadium 0.20-0.35%, zinc 0-3.0%, zirconium 0.2-0.4%, a maximum of 0.5% other elements and balance aluminum plus impurities. The alloy defines a microstructure having an aluminum matrix with the Zr and the V in solid solution after solidification. The matrix has solid solution Zr of at least 0.16% after heat treatment and solid solution V of at least 0.20% after heat treatment, and both Cu and Mg are dissolved into the aluminum matrix during the heat treatment and subsequently precipitated during the heat treatment. A process for heat treating an Al—Si—Cu—Mg—Fe—Zn—Mn—Sr-TMs alloy comprises heat treating the alloy to produce a microstructure having a matrix with Zr and V in solid solution after solidification.

21 Claims, 9 Drawing Sheets

(51) Int. Cl.
*C22F 1/043* (2006.01)
*B22D 21/00* (2006.01)

(56) References Cited

U.S. PATENT DOCUMENTS

2011/0126947 A1* 6/2011 Garat ..... C22C 21/02
148/701
2017/0016092 A1 1/2017 Yan et al.

FOREIGN PATENT DOCUMENTS

JP H02121766 5/1990
WO 2015126515 8/2015

OTHER PUBLICATIONS

Jeong, Chang-Yeol, High Temperature Mechanical Properties of Ai—Si—Mg—(Cu) Alloys for Automotive Cylinder Heads; 2013, Materials Transactions, vol. 54, No. 4, pp. 588-594, The Japan Institute of Metals.
Extended European Search Report for EP application 18185053.8, dated Sep. 26, 2018.

* cited by examiner

ADVANCED CAST ALUMINUM ALLOYS FOR AUTOMOTIVE ENGINE APPLICATION WITH SUPERIOR HIGH-TEMPERATURE PROPERTIES

GOVERNMENT SPONSORSHIP

This Invention was made with government support under Contract No. DE-EE0006020 awarded by the Department of Energy. The Government has certain rights in this invention.

FIELD

The present disclosure relates an aluminum alloy composition and method of manufacturing for high-cycle fatigue and high-temperature applications, for example, in cylinder heads and engine blocks for motor vehicles.

BACKGROUND

The statements in this section merely provide background information related to the present disclosure and may not constitute prior art.

Two methods of improving fuel economy in passenger vehicles that have been employed in the art include reducing the weight of the vehicle, and developing high-performance engines. To increase engine efficiency, the maximum operating temperature of engine components has increased from approximately 170° C. in earlier engines to peak temperatures well above 200° C. in recent engines. The increase in the operational temperatures requires a material with improved properties in terms of tensile, creep and fatigue strength. Cast aluminum alloys based on the Al—Si eutectic system with Cu and Mg additions, such as AA319, AA356, and AS7GU, have been widely used in automotive engine blocks and heads due to their low density, high thermal conductivity, good castability, and excellent low-temperature strength.

These cast aluminum alloys achieve their strength primarily from coherent or semi-coherent precipitates that form during post-solidification heat treatment, for example $\theta'$-$Al_2Cu$, $Q'$-$Al_5Cu_2Mg_8Si_6$ and $\beta'$-$Mg_2Si$ precipitates. These small precipitates are generally metastable rather than being in an equilibrium phase. As a result, the above-mentioned aluminum alloys lose their strength at elevated temperature because these metastable strengthening precipitates dissolve into the Al matrix or coarsen to equilibrium phases that do not provide the same level of strengthening. Experimental data show that the yield strength and ultimate tensile strength of AA319 alloy with a T7 heat treatment drops dramatically when exposed to temperatures between 170° C. and 200° C. In addition, the alloy endurance limit decreases from 88±6 MPa at room temperature to 62±8 MPa at 120° C.

A common strategy to improve the elevated-temperature performance of cast aluminum alloys is to modify the alloys with the addition of transition metals (TM). These TMs form thermally stable precipitates $L1_2$-$Al_3TM$, which are resistant to coarsening at high temperatures. However, for the vast majority of these Al-TM alloys, TMs are added to a dilute aluminum alloy, leading to very poor room-temperature performance, since the solubility of TMs in the Al matrix is so small that the volume fraction and density of these precipitates are insufficient to provide significant strengthening. For example, the maximum solubility of Ti, V, and Zr in Al is 1 wt. %, 0.6 wt. %, and 0.25 wt. %, respectively, much smaller than that of commonly used strengthening elements such as Cu (4.7 wt. %) and Mg (14.9 wt. %).

Improving high-cycle fatigue and performance at elevated temperatures for cast aluminum alloys having select TMs, especially in motor vehicle engine applications, is addressed by the present disclosure.

SUMMARY

In one form of the present disclosure, a high fatigue strength aluminum alloy is provided. The alloy comprises in wt. %:

| | |
|---|---|
| Aluminum (Al) | balance + impurities |
| Copper (Cu) | 3.0-3.5 |
| Iron (Fe) | 0-1.3 |
| Magnesium (Mg) | 0.24-0.35 |
| Manganese (Mn) | 0-0.8 |
| Silicon (Si) | 6.5-12.0 |
| Strontium (Sr) | 0-0.025 |
| Titanium (Ti) | 0.05-0.2 |
| Vanadium (V) | 0.20-0.35 |
| Zinc (Zn) | 0-3.0 |
| Zirconium (Zr) | 0.2-0.4 |
| Other Elements | 0-0.5 max |

The alloy defines a microstructure having an aluminum matrix with the Zr and the V in solid solution after solidification. The matrix has solid solution Zr of at least 0.16% after heat treatment and solid solution V of at least 0.20% after heat treatment, and both Cu and Mg are dissolved into the aluminum matrix during the heat treatment and subsequently precipitated during the heat treatment. In one form, the alloy is capable of withstanding up to 98 MPa at up to $10^7$ cycles at up to 180° C. after 100 hours soaking at the test temperature.

In another alloy of the present disclosure, the alloy comprises in wt. %: Si 6.5-8.0%, Fe 0-0.2%, Mn 0-0.4%, and Zn is 0% without changing the compositional ranges of the other elements and enabling cylinder heads formed by semi-permanent mold casting.

In yet another alloy of the present disclosure, the alloy comprises in wt. %: Si 8.0-12.0%, Fe 0.2-1.3%, and Sr is 0% without changing the compositional ranges of the other elements and enabling engine blocks formed by high-pressure die casting.

Another alloy of the present disclosure, the alloy comprises in wt. %: Si 7.2-7.7%, Cu 3.2-3.5%, Mg 0.24-0.28%, Zr 0.33-0.38%, V 0.22-0.28%, Mn 0-0.15%, and Ti 0.08-0.1% without changing the compositional ranges of the other elements. A form of this alloy of the present disclosure comprises in wt. %: Si 7.5%, Cu 3.4%, Mg 0.25, Zr 0.35%, V 0.25%, Ti 0.1%, Fe 0%, Mn 0%, and Sr 0% without changing the compositional ranges of the other elements.

In one alloy of the present disclosure, the alloy comprises in wt. % Zr 0.33-0.38% and V 0.22-0.28% without changing the compositional ranges of the other elements. A form of this alloy of the present disclosure comprises in wt. % Zr. 0.35% and V 0.25%.

In one form of the present disclosure, a process of heat treating an Al—Si—Cu—Mg—Fe—Zn—Mn—Sr-TMs alloy is provided with the process including Zr and V as TMs. The process comprises heat treating the alloy to produce a microstructure having an aluminum matrix with Zr and V in solid solution after solidification. The aluminum matrix contains both solid solution Zr of at least 0.16% and solid solution V of at least 0.20% after heat treatment. The aluminum matrix includes Cu and Mg dissolved into the aluminum matrix during the heat treatment and subsequently precipitated during the heat treatment.

In one process of the present disclosure, the alloy of the process comprises in wt. %: 6.5-8.0% Si, 3.0-3.5% Cu, 0.24-0.35% Mg, 0.2-0.4% Zr, 0.20-0.35% V, 0-0.2% Fe, 0-0.40% Mn, 0-0.025% Sr, 0.05-0.2% Ti, a maximum 0.5% total of other elements, and the balance Al. Where the alloy of the process is formed by semi-permanent mold casting followed by a three-stage heat treatment. In another process of the present disclosure, the alloy comprises in wt. %: Si 7.2-7.7%, Cu 3.2-3.5%, Mg 0.24-0.28%, Zr 0.33-0.38%, V 0.22-0.28%, Ti 0.08-0.1%, and Mn 0-0.15% without changing the compositional ranges of the other elements. In yet another process of the present disclosure, the alloy comprises in wt. %: Si 7.5%, Cu 3.4%, Mg 0.25%, Zr 0.35%, V 0.25%, Ti 0.1%, Fe 0%, Mn 0% and Sr 0% without changing the compositional ranges of the other elements.

In another process of the present disclosure, the alloy comprises in wt. % Zr 0.33-0.38% and V 0.22-0.28% without changing the compositional ranges of the other elements. In yet another process of the present disclosure, the alloy comprises Zr 0.35 wt. % and V 0.25 wt. %.

In another process of the present disclosure the three-stage heat treatment comprises a treatment at 375° C. for 6 hours, during which the Cu and Mg are dissolved; a treatment at 495° C. for 0.5 hours, during which the Cu and Mg are further dissolved; and a treatment at 230° C. for 3 hours, during which the Cu and Mg are precipitated.

In another process of the present disclosure, the alloy comprises in wt. %: 8.0-12.0% Si, 3.0-3.5% Cu, 0.24-0.35% Mg, 0.2-0.4% Zr, 0.20-0.35% V, 0.2-1.3% Fe, 0.05-0.2% Ti, 0-0.8% Mn, 0-3% Zn, a maximum 0.5% total of other elements, and the balance Al. Where the alloy of the process is formed by high-pressure die casting followed by a single-stage T5 heat treatment. In a process of the present disclosure, the single-stage T5 heat treatment comprises 205° C. for 4 hours, during which the Zr is maintained in the aluminum matrix to at least 0.16% and the V is maintained in the aluminum matrix to at least 0.20%, and the Cu and Mg are precipitated during the heat treatment. In yet another process of the present disclosure, the alloy can withstand up to 98 MPa at up to $10^7$ cycles at up to 180° C. after 100 hours soaking at the test temperature.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 4:
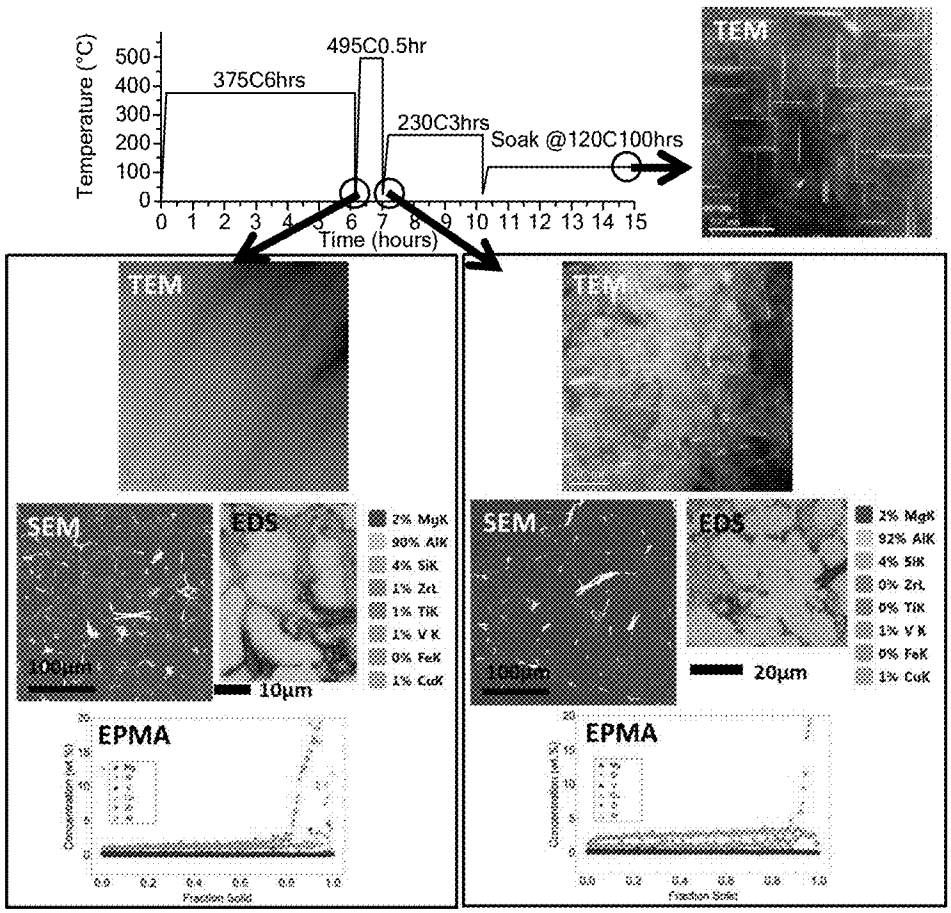
Figure 5:
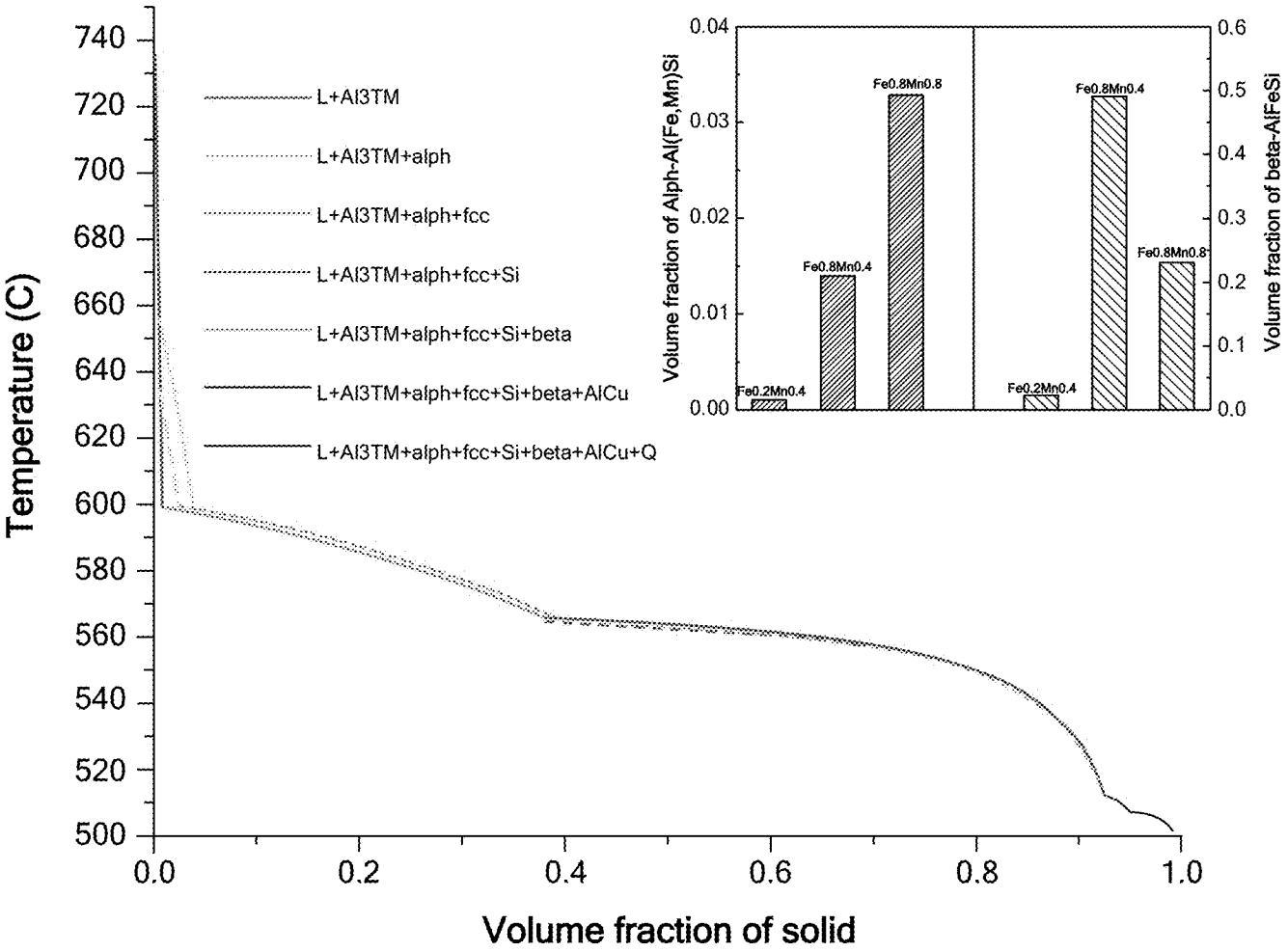
Figure 6:
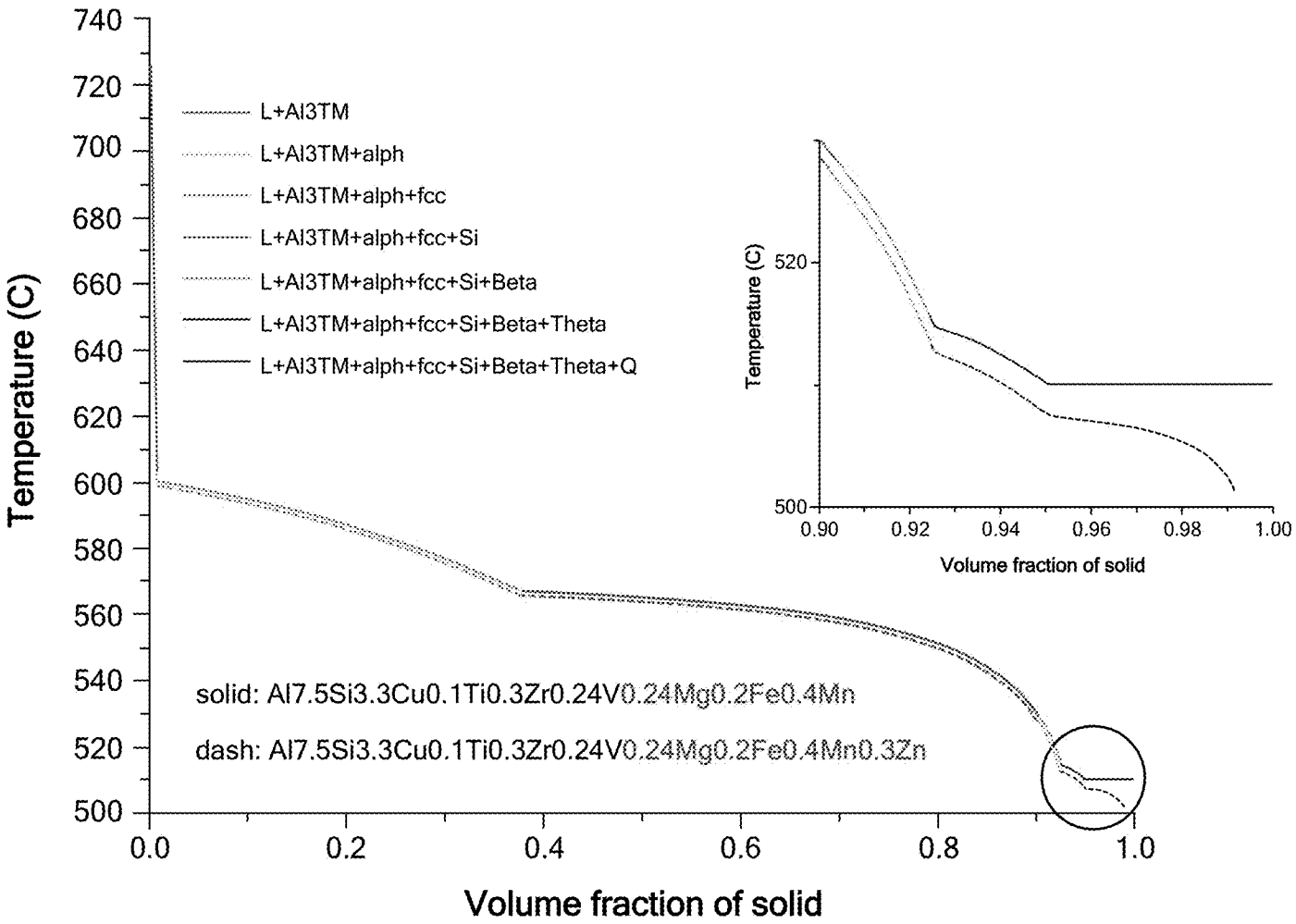
Figure 7:
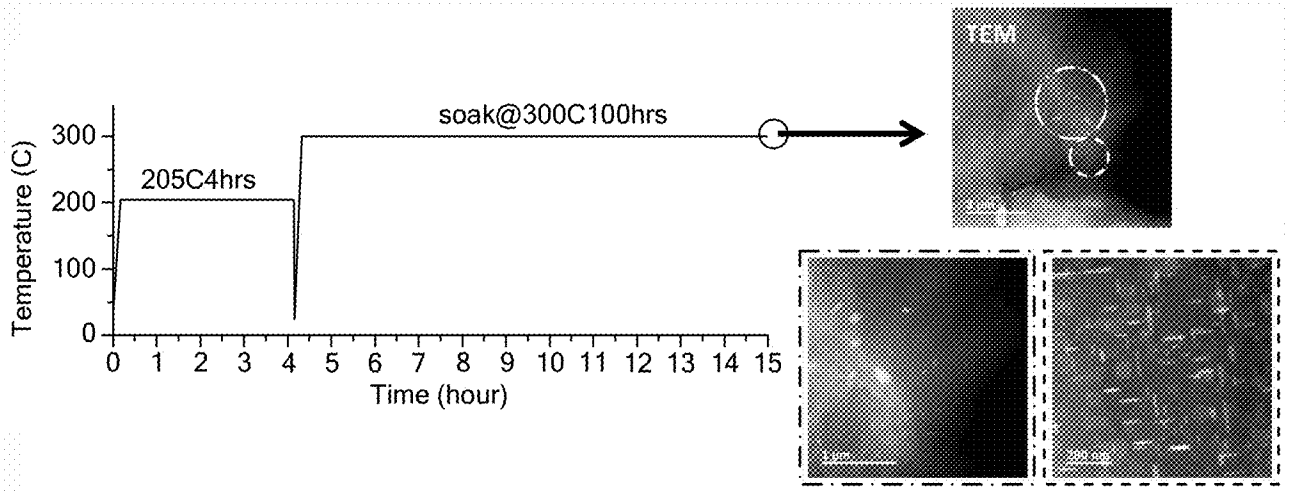
Figure 8:
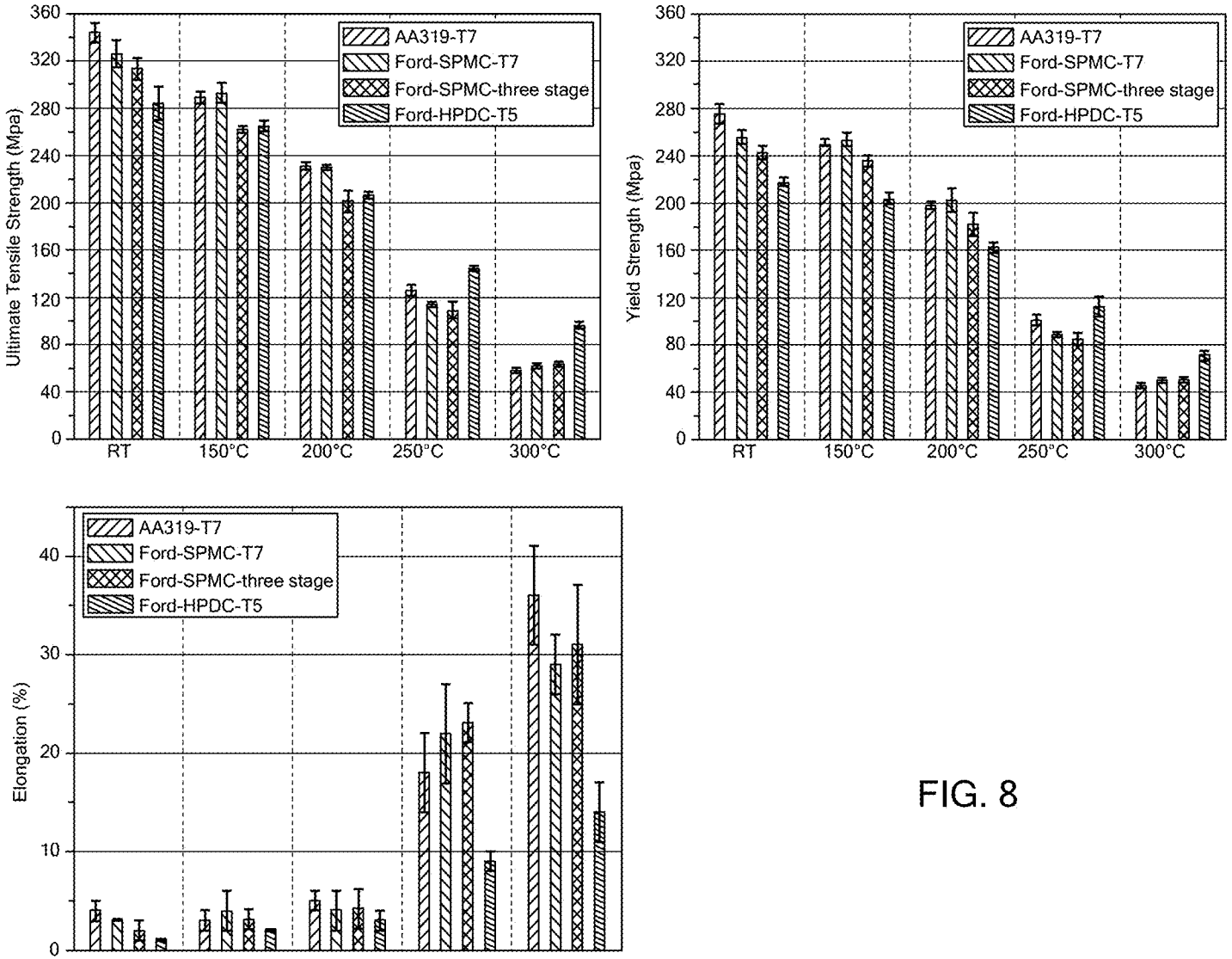
Figure 9:
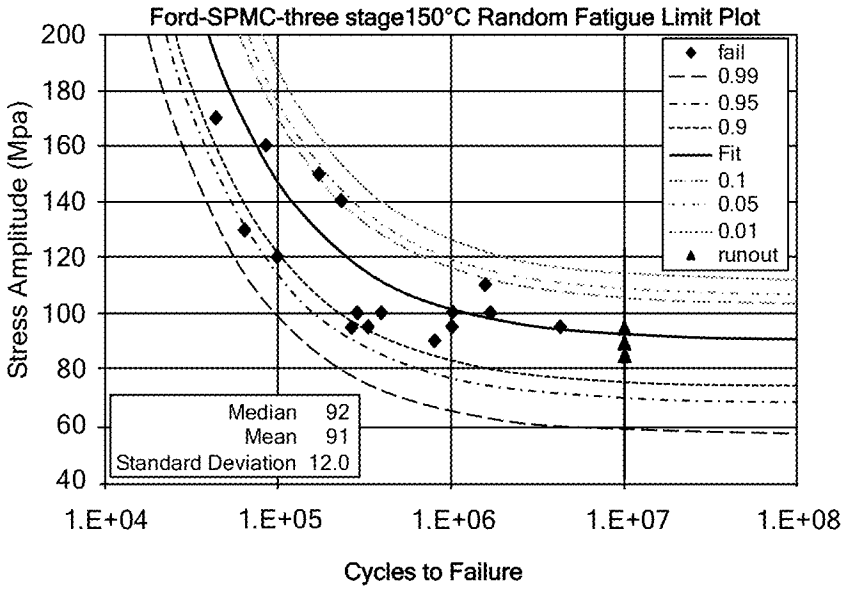
Figure 9:
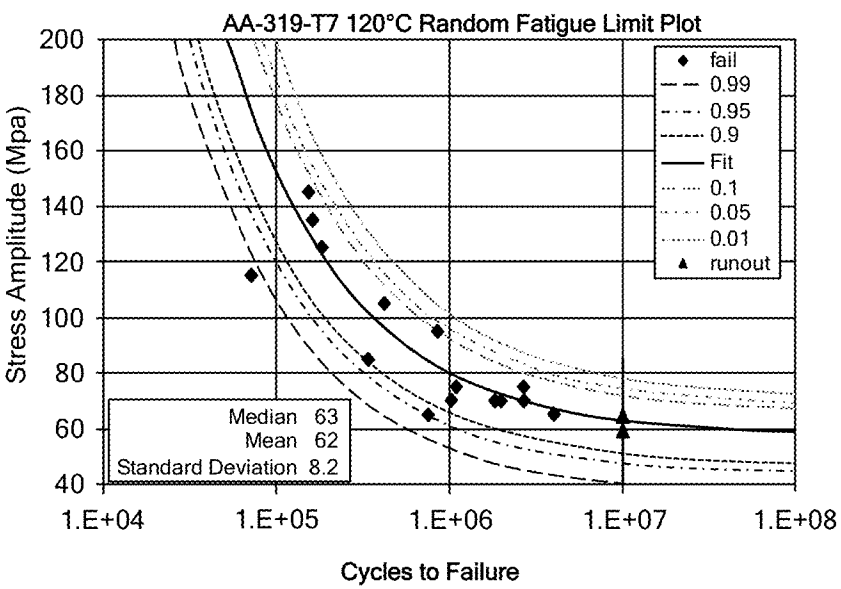

FIG. 4 is a graphical representation of the novel three-stage heat treatment developed for an alloy of the present disclosure that was previously formed using semi-permanent mold casting (SPMC), as well as Transmission Electron Microscopy (TEM) and Energy-Dispersive X-ray Spectroscopy (EDS) images of the alloy and plots of element concentration from Electron Probe Microscope Analysis (EPMA) measurements at different stages during the heat treatment, establishing the alloy microstructure;

FIG. 5 is a graphical representation of thermodynamic calculations displaying formation of α-Al(Fe, Mn)Si and β-AlFeSi during solidification;

FIG. 6 is a graphical representation of thermodynamic calculations, displaying how the eutectic temperature decreases with addition of Zn;

FIG. 7 is a graphical representation of the T5 heat treatment for an alloy of the present disclosure that was previously formed using a high-pressure die casting (HPDC) process, as well as TEM images, establishing the alloy microstructure resulting from such a heat treatment;

FIG. 8 are graphs of ultimate tensile strength, yield strength, and elongation of alloys and heat treatments of the present disclosure and the prior art, which were tested at various temperatures; and FIG. 9 are graphs of fatigue data for alloys of the present disclosure compared to the prior art.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

For the present disclosure, the alloy system of interest is Al—Si—Cu—Mg—Fe—Zn—Mn—Sr-TMs with TMs (transition metals) of particular interest being V and Zr. The inventors have discovered that growth kinetics of TM-containing (transition metal containing) precipitates during artificial aging in Al—Si-TM systems is much faster than that in Al-TM systems.

The present disclosure comprises an Al—Si—Cu—Mg—Fe—Zn—Mn—Sr-TMs (TM=Zr or V) alloy combined with a novel three-stage heat treatment for cylinder head applications using a semi-permanent mold process, and a second Al—Si—Cu—Mg—Fe—Zn—Mn—Sr-TMs (TM=Zr or V) alloy for engine block application using conventional high pressure die casting and T5 heat treatment. With novel alloys and the associated casting methods and heat treatments, this Al—Si—Cu—Mg—Fe—Zn—Mn—Sr-TMs (TM=Zr or V) alloy demonstrates improved fatigue (endurance limit) properties up to 180° C.

For cylinder head applications, the alloy of the present disclosure is a primary alloy with a low Fe content and is prepared by semi-permanent mold casting (SPMC). The cylinder head application utilizes a three-stage heat treatment, designed to improve the room-temperature properties, like yield strength and ductility, while maintaining the effects of TM additions for improvement of the endurance limit at 150° C.

For engine block applications, the alloy of the present disclosure can either be a primary alloy with a low Fe content or a secondary alloy with a relatively high Fe and Mn content. For engine block applications, the alloy of the present disclosure is prepared by a high-pressure die casting (HPDC) process and a T5 heat treatment, that shows a significant improvement in the endurance limit at 180° C.

The present disclosure discloses aluminum alloys including the compositions expressed in weight percentage in Table 1:

TABLE 1

Exemplary Composition of the Present Disclosure

| Element | wt. % |
|---|---|
| Aluminum (Al) | balance + impurities |
| Copper (Cu) | 3.0-3.5 |
| Iron (Fe) | 0-1.3 |
| Magnesium (Mg) | 0.24-0.35 |
| Manganese (Mn) | 0-0.8 |
| Silicon (Si) | 6.5-12.0 |
| Strontium (Sr) | 0-0.025 |
| Titanium (Ti) | 0.05-0.2 |
| Vanadium (V) | 0.20-0.35 |
| Zinc (Zn) | 0-3.0 |
| Zirconium (Zr) | 0.2-0.4 |
| Other Elements | 0-0.5 max |

In this form the alloy defines a microstructure having a matrix with the Zr and the V in solid solution after solidification, with solid solution Zr of at least 0.16% after heat treatment and solid solution V of at least 0.20% after heat treatment, and Cu and Mg dissolved into the matrix during the heat treatment and subsequently precipitated during the heat treatment.

The aluminum alloys of the present disclosure are prepared by at least two methods. First, semi-permanent mold casting (SPMC) with a three-stage heat treatment process is used for cylinder head applications. Second, high-pressure die casting (HPDC) with a T5 heat treatment is used for engine block applications.

Figure 1:
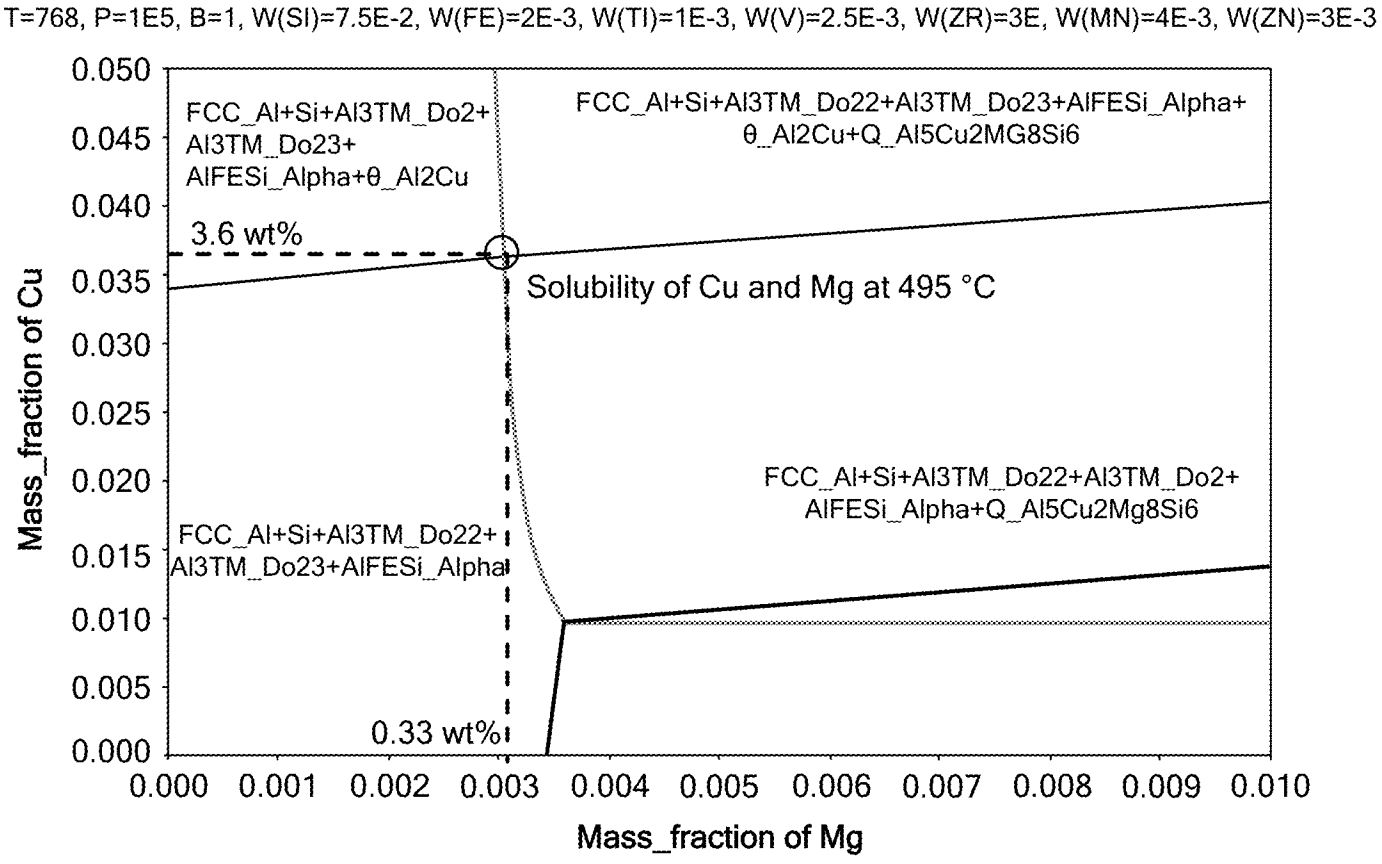
FIG. 1 is a graphical representation of thermodynamic calculations depicting the solubility of Mg (horizontal axis) and Cu (vertical axis), at the chosen solution treatment temperature, 495° C., the black text on the plot states the phases of the alloy in different regions of the plot, according to the prior art.

Copper (Cu) and Magnesium (Mg) form at least two strengthening precipitates θ'-($Al_2Cu$ and Q'-$Al_5Cu_2Mg_8Si_6$) in cast aluminum alloys. The thermodynamic calculations depicted in FIG. 1 indicate that at the chosen solution treatment temperature 495° C. the solubility of Cu is around 3.6 wt. % and the solubility of Mg is around 0.33 wt. %. To obtain sufficient strengthening from these Cu and Mg precipitates for engine applications, at the chosen solution treatment temperature of 495° C., Cu content ranges from 3-3.5 wt. % and Mg content ranges from 0.24-0.35 wt. %. Excessive copper reduces thermal conductivity, causes dimensional instability, reduces castability and causes hot tearing. At the solubility limit of copper (~3.6 wt. % at 495° C.) in the Al-matrix, copper no longer dissolves into the Al-matrix. Conversely, insufficient copper does not provide sufficient strengthening precipitates. Similarly, excessive magnesium increases oxidation of the melt surface in the foundry which increases the number of inclusions and defects in the castings. At the solubility limit of magnesium (~0.33 wt. % at 495° C.) in the Al-matrix, magnesium no longer dissolves into the Al-matrix. Conversely, insufficient magnesium does not provide sufficient strengthening precipitates.

Iron (Fe) is an impurity in cast aluminum alloys and is almost unavoidable. In the presence of Si, Fe forms brittle β-AlFeSi intermetallics with a needle morphology. These intermetallics are harmful to mechanical properties of the alloy. In addition, these intermetallics increase the porosity level of the alloy by blocking inter-dendritic feeding. For the SPMC alloy of the present disclosure (three-stage heat treatment), the Fe content is less than 0.2 wt. %, as the small amount of Fe minimally effects alloy properties. For the HPDC alloy of the present disclosure (T5 heat treatment), the Fe content ranges from 0.2-1.3 wt. %. With the presence of Fe, Manganese (Mn) is added to the alloy to reduce the adverse effects of Fe on alloy mechanical properties.

Manganese (Mn) transforms β-AlFeSi particles, which have a needle morphology, to the α-Al(Fe, Mn)Si phase. The α-Al(Fe, Mn)Si phase has a morphology resembling Chinese script and is less harmful to the mechanical properties of the alloy. According to thermodynamic calculations (FIG. 5), the fraction of β-AlFeSi phase increases with Fe content. By adding Mn, α-Al(Fe, Mn)Si forms before the Al-matrix forms, and the fraction of 13-AlFeSi decreases. Thus, the Mn content of the present disclosure ranges from 0-0.8 wt. % and the Mn content adjusts as the Fe content adjusts. For example, for a 0.8 wt. % Fe alloy, the Mn content is 0.8 wt. %, however the ratio of Fe to Mn is not necessarily 1:1.

Silicon (Si) is added to aluminum to form Al—Si eutectics to improve the castability of the alloys of the present disclosure. Fluidity and feeding characteristics are desirable characteristics in cast alloys. Fluidity is defined as the ability of the molten alloy to easily flow through thick and thin areas of the mold for long distances. Tests indicate that the fluidity of Al—Si alloys is highest at eutectic composition. Feeding is characterized by the ability of liquid metal to flow through dendritic networks to reach areas where contraction due to the liquid-to-solid phase change is occurring. If there is no liquid metal flow, porosity will result due to solidification shrinkage. Mold filling is more difficult in metal molds due to the high cooling rates, primarily because the time-to-freeze is decreased. The Si content according to the present disclosure is 6.5-8 wt. % for semi-permanent mold (SPMC) alloys, which experience a medium solidification rate. The Si content according to the present disclosure is 8-12 wt. % for high-pressure die cast (HPDC) alloys, which undergo a relatively high solidification rate. In addition, Si can precipitate with other elements during artificial aging to provide strengthening.

The Titanium (Ti) content ranges from 0.05-0.2 wt. % and is used as a grain refiner during solidification.

Vanadium (V) has the function of improving the elevated-temperature mechanical performance of the alloy of the present disclosure. When present in the aluminum matrix, V also improves the elevated-temperature fatigue endurance limit of the present disclosure. The V content ranges from 0.20-0.35 wt. %, as EPMA (electron probe micro analysis) measurements indicate 0.25 wt. % of V can be dissolved into the Al matrix. If the V content is more than 0.35 wt. %, the V forms coarse primary precipitates that have a minimal strengthening effect.

Zinc (Zn) is either from recycled materials or added to the alloy to minimize the adverse effects of Fe on alloy mechanical properties. Thermodynamic calculations (see FIG. 6) indicate that the eutectic temperature decreases with increasing amounts of Zn, thus, the Zn content ranges from 0-3.0 wt. %.

Zirconium (Zr) improves the elevated-temperature mechanical performance of the alloy of the present disclosure. When present in the aluminum matrix, Zr also improves the elevated-temperature fatigue endurance limit of the present disclosure. The Zr content ranges from 0.2-0.4 wt. % as EPMA (electron probe micro analysis) measurements indicate 0.16 wt. % of Zr can be dissolved into the Al matrix. If the Zr content is more than 0.4 wt. %, the Zr forms coarse primary precipitates that have a minimal strengthening effect.

Figure 2:
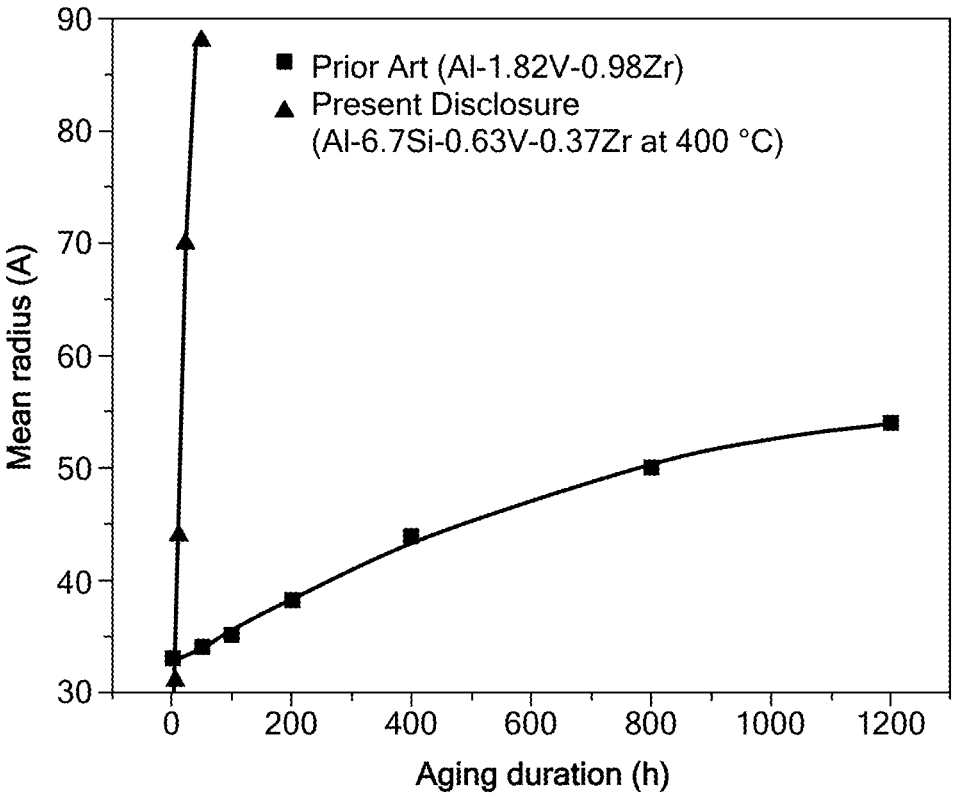
FIG. 2 is a graphical representation of growth kinetics of $L1_2$-$(Al, Si)_3TM$ in an Al—Si-TM system (blue) and $L1_2$-$Al_3TM$ precipitates in an Al-TM system according to the teachings of the present disclosure and the prior art, respectively.

Unlike Al—Zr, Al—V, and Al—Ti binary systems, in which the $L1_2$-$Al_3TM$ precipitates exhibit resistance to coarsening at elevated temperature, the precipitates forming in the Al—Si-TM (TM-Zr, V, Ti) systems are $L1_2$-$(Al, Si)_3TM$ (TM-Zr, V, Ti). FIG. 2 compares the aging behavior of $L1_2$-$(Al, Si)_3TM$ precipitates in an Al—Si-TM system, and that of $L1_2$-$Al_3TM$ in an Al-TM system, which the inventors have characterized with transmission electron microscopy (TEM). The accelerated growth kinetics of $L1_2$-$(Al, Si)_3TM$ precipitates is shown to be dramatically faster than that of $L1_2$-$Al_3TM$. Thus, the TM additions lose their strengthening effects at elevated temperatures, if traditional heat treatments such as T6 and T7 are utilized. That is because $L1_2$-$(Al, Si)_3TM$ precipitates will transform to their equilibrium structure during the long and high-temperature solution treatments in T6 and T7. Experimental data confirm the fact that aluminum alloys minimally benefit from TM additions through conventional T7 heat treatment.

As set forth above, SPMC applications of some alloys of the present disclosure are enabled by a novel three-stage heat treatment. Thus, conventional heat treatments, such as T6 and T7, cannot fully take advantage of TM (TM=Zr or V) additions as strengthening precipitates because these TM additions transform to coarse particles with an equilibrium crystal structure during the long-duration and high-temperature solution treatment stages of T6 and T7. Such coarsened particles provide almost no strengthening benefit. On the other hand, a solution treatment stage improves cylinder head applications because sufficient amounts of Cu/Mg should be dissolved into the Al matrix to form strengthening precipitates during artificial aging. Thus, a three-stage heat treatment was developed, comprising 375° C. for 6 hours as the first stage, 495° C. for 0.5 hours as the second stage, and 230° C. for 3 hours as the third stage.

The first stage of 375° C. for 6 hours is a low-temperature and long-duration heat treatment. As TEM imaging shows in FIG. 4, the TM additions (TM-Zr, V) remain in the Al matrix and minimal TM-containing particles are observed. Moreover, EPMA results show that the concentration of Cu and Mg in the Al matrix exhibit a minor increase, and macro-segregation is alleviated, compared to the as-cast sample.

The second stage of 495° C. for 0.5 hours is a high-temperature and short-duration heat treatment. As TEM imaging shows in FIG. 4, most TM additions remain in solid solution and few TM-containing particles were observed. Moreover, the EPMA data display that the concentration of Cu and Mg in the Al matrix exhibit a significant increase. The dissolved Cu and Mg form plate-shape θ'-$Al_2Cu$ precipitates during the subsequent aging step.

The third stage of 230° C. for 3 hours is an artificial over-aging heat treatment. As shown in FIG. 4, a high volume fraction of nano-scale plate-shape Er—$Al_2Cu$ and rod-shape Q'-$Al_5Si_2Mg_8Si_6$ precipitates form during the third stage to provide precipitation strengthening.

FIG. 4 includes TEM and EDS images of the alloys as well as plots of element concentration from EPMA measurements at different stages during the heat treatment, establishing the alloy microstructure.

Table 2 below shows various forms of the compositional ranges for the SPMC three-stage heat treatment alloys.

TABLE 2

Compositions of SPMC three-stage heat treatment of the present disclosure

| Element | wt. % | Alternate Range (wt. %) | Targeted Composition (wt. %) |
|---|---|---|---|
| Aluminum (Al) | balance + impurities | balance + impurities | balance + impurities |
| Copper (Cu) | 3.0-3.5 | 3.2-3.5 | 3.4 |
| Iron (Fe) | 0-0.20 | 0-0.20 | 0 |
| Magnesium (Mg) | 0.24-0.35 | 0.24-0.28 | 0.25 |
| Manganese (Mn) | 0-0.4 | 0-0.15 | 0 |
| Silicon (Si) | 6.5-8.0 | 7.2-7.7 | 7.5 |
| Strontium (Sr) | 0-0.025 | 0-0.025 | 0 |
| Titanium (Ti) | 0.05-0.2 | 0.08-0.10 | 0.10 |
| Vanadium (V) | 0.20-0.35 | 0.22-0.28 | 0.25 |
| Zirconium (Zr) | 0.20-0.40 | 0.33-0.38 | 0.35 |
| Other elements | 0.5 max | 0.5 max | 0.5 max |

Referring to FIG. 5, thermodynamic calculations for the formation of α-Al(Fe, Mn)Si are shown, indicated as alph in the plot, and β-AlFeSi, indicated as beta, during solidification. The differences between the solid, dash and dotted curves show that the volume fraction of α-Al(Fe, Mn)Si increases with the Fe+Mn content, and the volume fraction of β-AlFeSi increases with Fe but decreases with Mn. The inset displays the change in α-Al(Fe, Mn)Si and β-AlFeSi volume fractions quantitatively.

Referring also to FIG. 6, a graphical representation of thermodynamic calculations is shown, displaying how the eutectic temperature decreases with addition of Zn, as emphasized in the inset.

Engine block applications of the present disclosure use a T5 heat treatment. Components made by the high-pressure die cast (HPDC) process are not amenable to solution treatment because of the internal pores that form as an ever-present feature of this process. These pores contain gas or gas-forming compounds and thus expand during conventional solution treatments at high temperatures (e.g. 495° C.), resulting in the formation of surface blisters on the castings. Thus, a T5 heat treatment is used for engine block alloys. Although the room-temperature properties of these alloys with T5 are not as high as those of alloys with T6 or T7 heat treatments, the room-temperature properties are sufficient for room-temperature performance. The disclosed alloy with a T5 heat treatment has improved elevated-temperature properties because the TM additions (TM-Zr, V) are kept in the Al matrix in this heat treatment, as shown in FIG. 7. In addition, after pre-exposure at 300° C. for 100 hours, most of θ'-$Al_2Cu$ precipitates are still small and coherent within the Al-matrix. Therefore, the HPDC-T5 alloy of the present disclosure has a significant improvement on both elevated temperature endurance and tensile properties.

Table 3 below shows the compositional ranges for the HPDC T5 heat treatment alloys according to the present disclosure.

TABLE 3

Compositions of HPDC T5 Alloys of the present disclosure

| Element | wt. % | Alternate Range (wt. %) | Targeted Composition (wt. %) |
|---|---|---|---|
| Aluminum (Al) | balance + impurities | balance + impurities | balance + impurities |

TABLE 3-continued

Compositions of HPDC T5 Alloys of the present disclosure

| Element | wt. % | Alternate Range (wt. %) | Targeted Composition (wt. %) |
|---|---|---|---|
| Copper (Cu) | 3.0-3.5 | 3.2-3.5 | 3.4 |
| Iron (Fe) | 0.20-1.3 | 0.20-1.0 | 0.25 |
| Magnesium (Mg) | 0.24-0.35 | 0.24-0.28 | 0.25 |
| Manganese (Mn) | 0-0.80 | 0.35-0.50 | 0.40 |
| Silicon (Si) | 8.0-12.0 | 9.0-11.0 | 9.5 |
| Titanium (Ti) | 0.05-0.2 | 0.08-0.10 | 0.10 |
| Vanadium (V) | 0.20-0.35 | 0.22-0.28 | 0.25 |
| Zinc (Zn) | 0-3.0 | 0-1.5 | 0.0 |
| Zirconium (Zr) | 0.20-0.40 | 0.33-0.38 | 0.35 |
| Other elements | 0.5 max | 0.5 max | 0.5 max |

Figure 3:
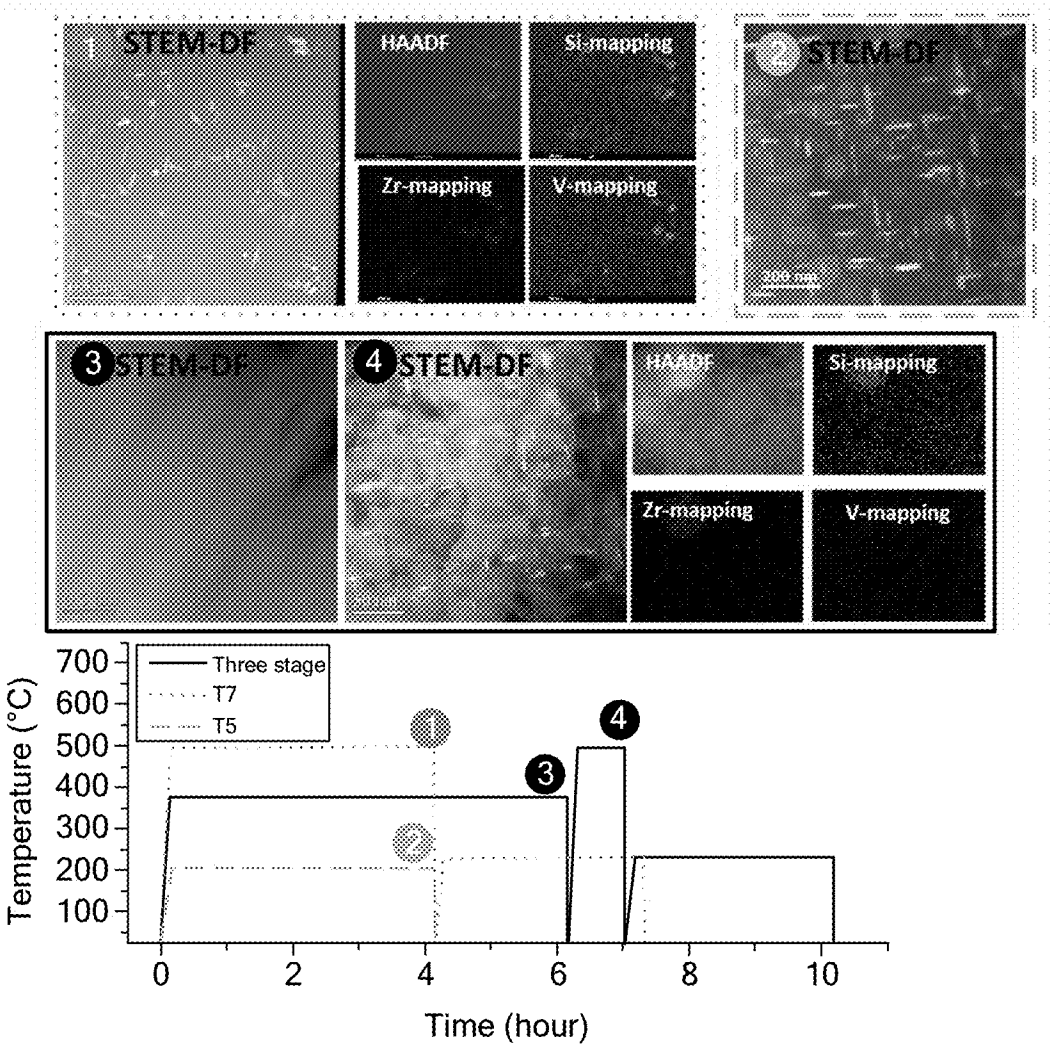
FIG. 3 is a graphical representation of a comparison of three different heat treatments, the third including that of the present disclosure with a three-stage heat treatment used with an alloy that was previously formed using semi-permanent mold casting (SPMC), the first showing that Zr and V lose their strengthening effects in T7 heat treatment.

A three-stage heat treatment enables SPMC alloys and a T5 heat treatment enables HPDC alloys in that the conventional T7 heat treatment cannot take advantage of TM additions in Al—Si-TM systems. TM additions coarsen very rapidly during the high-temperature and long-duration solution treatment of the T7 heat treatment. As point 1 indicates in FIG. 3, very coarse Zr and V particles are observed after solution treatment, which have no effect in improving alloys' elevated-temperature performance. On the other hand, Zr and V can be maintained in Al-matrix in both three-stage heat and T5 heat treatment to provide strengthening at elevated temperature.

In an exemplary application of the present disclosure, two different aluminum alloys were cast in the form of cylinders (120 mm long and 20 mm in diameter) in a 100-lb electric resistance furnace.

One of the alloys, with a composition of Al-7.55i-3.3Cu-0.24Mg-0.16Fe-0.1Ti-0.25V-0.4Zr, is representative of the semi-permanent mold cast (SPMC) alloys of the present disclosure. Two different heat treatments were used for this alloy, traditional T7 and the novel three-stage of the present disclosure, to display the superior performance of the three-stage treatment.

The other alloy, with a composition of Al-9.35i-3.3Cu-0.24Mg-0.25Fe-0.4Mn-0.1Ti-0.23V-0.4Zr, is representative of the high-pressure die cast (HPDC) version of the alloys of the present disclosure. A T5 heat treatment was used for the HPDC alloy.

Samples were machined into the dog-bone shape for quasi-static tensile and endurance limit testing. Quasi-static tensile tests were performed at room temperature, 150° C., 200° C., 250° C. and 300° C. For the endurance limit tests, different testing temperatures, including room temperature, 120° C., 150° C. and 180° C., were selected. All samples were pre-exposed to the testing temperature for a soak time of 100 hours.

The tensile properties, including ultimate tensile strength (UTS), yield strength (YS), and elongation, of AA319-T7, SPMC-T7, SPMC three-stage, and HPDC-T5 are summarized in FIG. 6. At operating temperatures of less than 150° C., the ultimate tensile strength (UTS) and Yield Strength (YS) of AA319 and the SPMC-T7 heat treatment alloy were measured to be slightly higher than the alloys of the present disclosure (SPMC three-stage and HPDC-T5). This is because the AA319 and SPMC-T7 alloys have experienced longer-duration and higher-temperature solution treatments than the alloys of the present disclosure, resulting in the dissolution of more Cu and Mg in the Al matrix. However, the performance of the alloys of the present disclosure (SPMC three-stage and HPDC-T5) is sufficient for the intended applications at these relatively lower temperatures, and is improved over the current production alloys (AA319-T7 and SPMC-T7) at higher temperatures. When the temperature is above 250° C., HPDC-T5 has a much higher UTS and YS than the other three alloys because the TM additions are maintained within the Al matrix. The SPMC three-stage alloy is applicable for applications requiring higher ductility such as cylinder heads.

Although the proposed SPMC three-stage alloy of the present disclosure has comparable room-temperature endurance limits with the current production alloys, the SPMC three-stage alloy has a much higher endurance limit at 120° C. than AA319-T7 and SPMC-T7 (see Table 4 and FIG. 9). This result indicates that the elevated-temperature endurance limit benefits from TM additions through the designed heat treatment. Minimal enhancement is achieved solely through the proposed chemistry, since AA319-T7 and SPMC-T7 have comparable endurance limits at 120° C. In addition, FIG. 9 shows that the enhanced endurance limit of SPMC three-stage is maintained up to at least 150° C., and the data from this testing is shown below in Table 4:

TABLE 4

Endurance limits of various alloys at different testing temperatures, after 100 hour soaking at the test temperature

| Alloy | Room Temperature | 120° C. | 150° C. | 180° C. |
|---|---|---|---|---|
| AA319-T7 | 88 ± 6 | 62 ± 8 | <62 | <<62 |
| SPMC-T7 | 89 ± 6 | 68 ± 17 | <68 | <<68 |
| SPMC three-stage | 83 ± 9 | 91 ± 12 | 92 ± 2 | |
| HPDC-T5 | — | — | 97 ± 7 | 98 ± 9 |

Alloys processed according to the HPDC-T5 have an excellent elevated-temperature endurance limit, 98±9 MPa up to at least 180° C. after 100 hours soaking at the test temperature, a significant improvement in the high-temperature performance of available alloys for engine block applications.

The alloys of the present disclosure, SPMC three-stage and HPDC-T5, present significant improvements over the elevated-temperature endurance limit of currently available alloys for cylinder head and engine block applications in the automotive industry. Compared to the currently available alloys for cylinder heads and engine blocks with heat treatments, the alloys of the present disclosure and the associated heat treatments have achieved unique microstructurel features, leading to the desired improvements in performance.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A high fatigue strength aluminum alloy comprising, in wt. %:

Cu between 3.0-3.5%;
Fe between 0-1.3%;
Mg between 0.24-0.35%;
Mn between 0-0.8%;
Si between 6.5-12.0%;
Sr between 0-0.025%;
Ti between 0.05-0.2%;
V between 0.22-0.28%;

Zn between 0-3.0%;
Zr between 0.33-0.38%;
maximum 0.5% other elements; and
balance Al,
wherein the alloy defines a microstructure having a matrix with the Zr and the V in solid solution after solidification, with solid solution Zr of at least 0.16% after heat treatment and solid solution V of at least 0.20% after heat treatment, and the Cu and the Mg dissolved into the matrix during the heat treatment and subsequently precipitated during the heat treatment.

2. The alloy according to claim 1, wherein the alloy is capable of withstanding up to 98 MPa at up to $10^7$ cycles at up to 180° C. after 100 hours soaking at 180° C.

3. The alloy according to claim 1, wherein the Si is between 6.5-8.0%, the Fe is 0-0.2%, the Mn is 0-0.4%, the Sr is 0-0.025%, and the Zn is 0%.

4. A cylinder head having the alloy according to claim 3 and being formed by semi-permanent mold casting.

5. The alloy according to claim 1, wherein the Si is 8.0-12.0% and the Fe is 0.2-1.3%.

6. An engine block having the alloy according to claim 5 and being formed by high-pressure die casting.

7. The alloy according to claim 1, wherein:
the Mn is between 0-0.4%; and
the Si is between 6.5-8.0%.

8. The alloy according to claim 7, wherein:
the Cu is between 3.2-3.5%;
the Mg is between 0.24-0.28%;
the Mn is between 0-0.15%;
the Si is between 7.2-7.7%; and
the Ti is between 0.08-0.1%.

9. The alloy according to claim 8, wherein:
the Cu is 3.4%;
the Fe is 0%;
the Mg is 0.25%;
the Mn is 0%;
the Si is 7.5%;
the Sr is 0%;
the Ti is 0.1%;
the V is 0.25%; and
the Zr is 0.35%.

10. The alloy according to claim 1, wherein:
the Fe is between 0.20-1.3%; and
the Si is between 8.0-12.0%.

11. The alloy according to claim 10, wherein:
the Cu is between 3.2-3.5%;
the Fe is between 0.20-1.0%;
the Mg is between 0.24-0.28%;
the Mn is between 0.35-0.50%;
the Si is between 9.0-11.0%;
the Ti is between 0.08-0.10%; and
the Zn is between 0-1.5%.

12. The alloy according to claim 11, wherein:
the Cu is 3.4%;
the Fe is 0.25%;
the Mg is 0.25%;
the Mn is 0.40%;
the Si is 9.5%;
the Ti is 0.10%;
the V is 0.25%;
the Zn is 0%; and
the Zr is 0.35%.

13. An engine block formed from a heat treated cast high fatigue strength aluminum alloy comprising, in wt. %:
Cu between 3.0-3.5%;
Fe between 0-1.3%;
Mg between 0.24-0.35%;
Mn between 0-0.8%;
Si between 6.5-12.0%;
Sr between 0-0.025%;
Ti between 0.05-0.2%;
V between 0.22-0.28%;
Zn between 0-3.0%;
Zr between 0.33-0.38%;
maximum 0.5% other elements; and
balance Al,
wherein the alloy defines a microstructure having a matrix with the Zr and the V in solid solution after solidification, with solid solution Zr of at least 0.16% after the heat treatment and solid solution V of at least 0.20% after the heat treatment, the Cu and the Mg dissolved into the matrix during the heat treatment and subsequently precipitated during the heat treatment, and the alloy is capable of withstanding up to 98 MPa at up to $10^7$ cycles at up to 180° C. after 100 hours soaking at 180° C.

14. The engine block according to claim 13, wherein:
the Mn is between 0-0.4%; and
the Si is between 6.5-8.0%.

15. The engine block according to claim 14, wherein:
the Cu is between 3.2-3.5%;
the Mg is between 0.24-0.28%;
the Mn is between 0-0.15%;
the Si is between 7.2-7.7%; and
the Ti is between 0.08-0.1%.

16. The engine block according to claim 15, wherein:
the Cu is 3.4%;
the Fe is 0%;
the Mg is 0.25%;
the Mn is 0%;
the Si is 7.5%;
the Sr is 0%;
the Ti is 0.1%;
the V is 0.25%; and
the Zr is 0.35%.

17. The engine block according to claim 13, wherein the Si is 8.0-12.0% and the Fe is 0.2-1.3%.

18. The engine block according to claim 17 and being formed by high-pressure die casting.

19. A cylinder head formed from a heat treated cast high fatigue strength aluminum alloy comprising, in wt. %:
Cu between 3.0-3.5%;
Fe between 0-1.3%;
Mg between 0.24-0.35%;
Mn between 0-0.8%;
Si between 6.5-12.0%;
Sr between 0-0.025%;
Ti between 0.05-0.2%;
V between 0.22-0.28%;
Zn between 0-3.0%;
Zr between 0.33-0.38%;
maximum 0.5% other elements; and
balance Al,
wherein the alloy defines a microstructure having a matrix with the Zr and the V in solid solution after solidification, with solid solution Zr of at least 0.16% after the heat treatment and solid solution V of at least 0.20% after the heat treatment, the Cu and the Mg dissolved into the matrix during the heat treatment and subsequently precipitated during the heat treatment, and the alloy is capable of withstanding up to 98 MPa at up to $10^7$ cycles at up to 180° C. after 100 hours soaking at 180° C.

20. The cylinder head according to claim 19, wherein the Si is between 6.5-8.0%, the Fe is 0-0.2%, the Mn is 0-0.4%, the Sr is 0-0.025%, and the Zn is 0%.

21. The cylinder head according to claim 20 and being formed by semi-permanent mold casting.

* * * * *